US009525257B1

(12) United States Patent
Moore et al.

(10) Patent No.: US 9,525,257 B1
(45) Date of Patent: Dec. 20, 2016

(54) UNIVERSAL ADAPTER FOR ULTRASONIC PROBE CONNECTORS

(71) Applicant: Acertara Acoustic Laboratories LLC, Longmont, CO (US)

(72) Inventors: Levi Moore, Lyons, CO (US); Peter Leonhardt, Loveland, CO (US)

(73) Assignee: Acertara Acoustic Laboratories LLC, Longmont, CO (US)

( * ) Notice: Subject to any disclaimer, the term of this patent is extended or adjusted under 35 U.S.C. 154(b) by 0 days.

(21) Appl. No.: 15/146,100

(22) Filed: May 4, 2016

Related U.S. Application Data

(60) Provisional application No. 62/171,692, filed on Jun. 5, 2015.

(51) Int. Cl.

| | |
|---|---|
| ***H01R 13/64*** | (2006.01) |
| ***H01R 33/74*** | (2006.01) |
| ***H01R 13/629*** | (2006.01) |
| ***H01R 13/22*** | (2006.01) |
| *H01R 107/00* | (2006.01) |
| *B06B 1/06* | (2006.01) |

(52) U.S. Cl.
CPC ..... *H01R 33/74* (2013.01); *H01R 13/22* (2013.01); *H01R 13/629* (2013.01); *B06B 1/06* (2013.01); *H01R 2107/00* (2013.01)

(58) Field of Classification Search
CPC ..... H01R 33/74; H01R 13/629; H01R 13/22; H01R 2107/00; H01R 1/06
USPC ..... 439/378, 700
See application file for complete search history.

(56) References Cited

U.S. PATENT DOCUMENTS

| | | | | |
|---|---|---|---|---|
| 8,585,414 | B2 * | 11/2013 | Takeda | H01R 12/7005 439/160 |
| 8,734,172 | B2 * | 5/2014 | Takei | H01R 12/7005 439/248 |
| 8,764,468 | B1 * | 7/2014 | Feroli | H01R 13/04 439/248 |
| 8,951,055 | B2 * | 2/2015 | Eusterholz | H01R 13/6315 439/378 |
| 2012/0295470 | A1 * | 11/2012 | Nagasaka | H01R 13/6272 439/378 |

* cited by examiner

*Primary Examiner* — Khiem Nguyen
(74) *Attorney, Agent, or Firm* — Marsh Fischmann & Breyfogle LLP; Jonathon A. Szumny

(57) ABSTRACT

A device for selectively establishing an electrical connection between an array of electrical contacts of a connector of an ultrasound system and an electrical apparatus (e.g., testing apparatus). The device includes a tray including a floor and a wall extending away from and surrounding the floor to define a receptacle of the tray, a shaft non-movably fixed to the floor within the receptacle and including a longitudinal axis that extends away from the floor, and an electrical connection assembly rotatably secured about the shaft within the receptacle to selectively establish an electrical connection between the electrical contact array of the connector and the electrical apparatus. The device is configured to accept ultrasound connectors of a wide variety of shapes, sizes, electrical contact array configurations, and the like.

22 Claims, 16 Drawing Sheets

UNIVERSAL ADAPTER FOR ULTRASONIC PROBE CONNECTORS

CROSS REFERENCE TO RELATED APPLICATION

This application claims priority to U.S. Patent App. No. 62/171,692, entitled "UNIVERSAL ADAPTER FOR ULTRASONIC PROBE CONNECTORS," and filed on Jun. 5, 2015, the entire contents of which are incorporated herein in their entirety as if set forth in full.

BACKGROUND

1. Field of the Invention

This application relates generally to acoustic systems and, more specifically, ultrasonic probes and transducers.

2. Relevant Background

Acoustic (e.g., ultrasonic) imaging is an important technique that may be used at different acoustic frequencies for varied applications that range from medical imaging to nondestructive testing of structures. The techniques generally rely on the fact that different structures have different acoustic impedances, allowing characterization of structures and their interfaces from information embodied by the different scattering patterns that result. While most applications use radiation reflected from structures, some techniques also make use of information in transmitted patterns.

Modern ultrasound systems typically include an imaging console and an ultrasonic transducer (e.g., transducer head) that is electrically interconnectable to the imaging console by any appropriate cable assembly and a connector assembly, where the connector assembly is configured to interface with a corresponding port on the imaging console. The imaging console transmits a drive signal to the ultrasonic transducer to cause piezoelectric elements of the ultrasonic transducer to transmit acoustic waves (e.g., ultrasound, ultrasonic waves) to a subject. The ultrasonic transducer is then configured to receive reflection waves reflected by the interior of the subject and pass the same to the imaging console for generation of one or more corresponding images. For example, many modern systems are based on multiple-element array transducers that may have linear, curved-linear, phased-array or similar characteristics. Summing the contributions of the multiple elements that form a transducer array allows images to be formed. The ultrasonic transducer, cable assembly and connector may be referred to as an "acoustic probe" or "ultrasonic probe."

Post-installation electrical testing on ultrasound systems is essential to ensure patient and user safety. Oftentimes, this testing is conducted on the ultrasound system/probe combination to ensure that the equipment meets specific safety standards for acceptable levels of electrical leakage. In addition to that important role, electrical leakage values above mandated levels can indicate other failures within the ultrasound system equipment chain. For instance, elevated levels of electrical leakage can indicate the breakdown of the insulating materials in contact with the patient. More specifically, such a breakdown in these materials can often degrade the system performance and provide a shelter for harmful bacteria to hide from standard cleaning procedures, thus increasing the risk of cross-contamination. The presence of harmful electrical leakage may not always be perceptible to the operators or the patients.

In any case, ultrasound systems use a wide array of probes (e.g., transducers, connector, and/or the like) that differ in various manners. For instance, ultrasound system connectors, which are intended to provide a direct electrical connection between the imaging console and the ultrasound transducer, often share little in common relative to their physical construction, shape, size, depth, and/or locking mechanism (i.e., locking mechanism to lock the connector to the port of the imaging console). This direct electrical connection is typically made either through an array of dedicated metal pins or through electrically conductive pads on printed circuit boards or flexible circuit boards. In addition to the diversity of electrical connection configurations, connectors often have shrouds (e.g., metal) surrounding the electrical array that differ in width, depth, length, and/or the like.

The current approach to conducting electrical leakage testing of ultrasound system connectors that differ in various manners as discussed above involves providing matched connector plugs for each style of available connector. More specifically, a different respective plug is designed to establish an electrical connection between each different respective connector and a testing unit for purposes of conducting electrical leakage tests of the various different connectors. However, this arrangement creates financial and logistical problems for users of existing electric leakage testing units.

SUMMARY

In view of the foregoing, the inventors have determined that there is a need for a device that makes a suitable electrical connection to many different styles and/or configurations of ultrasound system connectors such as for use in electrically connecting the connector to a testing unit, to a port on an imaging console, and/or the like. That is, such a device would allow a user to selectively establish electrical connections between an electrical contact array (e.g., pins, pads, etc.) of each of a plurality of different ultrasound connectors (e.g., in relation to shape, size, electrical contact array configuration, and/or the like) and an electrical apparatus such as a testing apparatus, such as for purposes of measuring electrical leakage values of each of a plurality of different connectors using the same device. The device may also include one or more appropriate safety features to protect users from any electrical discharge, one or more locking features to allow users to establish the electrical connection between the device and the connector free of the users having to physically hold the connector in place, and/or the like.

Broadly, the disclosed device includes a non-conductive tray including a floor and a wall extending away from and surrounding the floor to define a receptacle of the tray, a shaft non-movably fixed to or relative to the floor within the receptacle and including a longitudinal axis that extends away from the floor, and an electrical connection assembly or unit rotatably secured about the shaft within the receptacle to selectively establish an electrical connection between the electrical contact array of each of a number of different connectors and an electrical apparatus such as an electrical leakage testing unit and/or the like. For instance, the electrical connection assembly may include a base member fixed over the floor for rotation about the longitudinal axis of the shaft, a false floor or platform attached to the base member for translation towards and away from the base member along the longitudinal axis of the shaft, and a conductive matrix that defines a plurality of conductive paths between a docking portion of the false floor and the base member, where the docking portion of the false floor is configured to receive (e.g., electrically contacts) an array of electrical contacts of the connector. The false floor may be non-rotatable relative to the base member.

In this regard, a user may establish electrical contact between the electrical contact array of the connector and the conductive matrix (e.g., through the docking portion) and then depress (e.g., translate) the false floor and connector along the longitudinal axis of the shaft towards the base member and rotate the entire electrical connection assembly relative to the tray in one of a clockwise or counterclockwise direction from a first rotational position into a second rotational position to establish an electrical connection between the electrical contact array of the connector and the electrical apparatus via the base member and conductive matrix. A user may disestablish the electrical connection between the electrical contact array of the connector and the electrical apparatus by way of again depressing the false floor and connector towards the base member and then rotating the entire electrical connection assembly relative to the tray in the other of a clockwise or counterclockwise direction from the second rotational position into the first rotational position which electrically disconnects the base member from the electrical apparatus.

The disclosed device takes advantage of the notion that an electrical connection to every electrical contact (e.g., every pin and/or pad) or the electrical contact array of the connection may not be necessary in order to properly conduct certain types of tests of the connector such as electrical leakage tests. In one arrangement, the docking portion of the false floor may include a matrix of apertures therethrough into which ends of the matrix of conductive paths (e.g., conductive springs, conductive wires, etc.) are configured to be appropriately received and fixed. In this regard, receipt of at least some of the electrical contacts of the array of the connector (e.g., at least one or more ground pins) in at least some of the matrix of apertures and contact with at least some of the matrix of conductive paths to facilitate testing of the connector upon depression and rotation of the false floor and connector into the second rotational position. In one variation, the docking portion may include any appropriate electrically conductive layer (e.g., as just one example, a layer of conductive felt) disposed over and in contact with the ends of the matrix of conductive paths. For instance, the electrically conductive layer may be disposed within a depression of the false floor and over the matrix of apertures so as to contact the ends of the matrix of conductive paths. The electrical contact array of the connector may be placed over and into electrical contact with the electrically conductive layer to facilitate testing of the connector upon depression and rotation of the false floor and connector into the second rotational position.

In one arrangement, the user may insert a locating shaft or stem of the connector into the shaft of the device in conjunction with establishing the electrical contact between the electrical contact array of the connector and the docking portion and/or the depression of the false floor such that the rotation of the false floor and connector brings a locking pin of the locating stem under a locking tab of the shaft in the second rotational position to inhibit removal of the locating stem from the shaft (and thus disconnection of the electrical contact array of the connector from the docking portion of the false floor) absent the false floor and connector again being depressed and then rotated in the other of the clockwise or counterclockwise direction back into the first rotational position.

Any of the embodiments, arrangements, or the like discussed herein may be used (either alone or in combination with other embodiments, arrangement, or the like) with any of the disclosed aspects. Merely introducing a feature in accordance with commonly accepted antecedent basis practice does not limit the corresponding feature to the singular. Any failure to use phrases such as "at least one" does not limit the corresponding feature to the singular. Use of the phrase "at least generally," "at least partially," "substantially" or the like in relation to a particular feature encompasses the corresponding characteristic and insubstantial variations thereof. Furthermore, a reference of a feature in conjunction with the phrase "in one embodiment" does not limit the use of the feature to a single embodiment.

In addition to the exemplary aspects and embodiments described above, further aspects and embodiments will become apparent by reference to the drawings and by study of the following descriptions.

A further understanding of the nature and advantages of the present invention may be realized by reference to the remaining portions of the specification and the drawings, wherein like reference labels are used through the several drawings to refer to similar components. In some instances, reference labels are followed with a hyphenated sublabel; reference to only the primary portion of the label is intended to refer collectively to all reference labels that have the same primary label but different sublabels.

DETAILED DESCRIPTION

While much of the description below makes use of specific examples in discussing various aspects of the invention, such examples are intended merely for illustrative purposes and the invention is not necessarily limited by such examples.

Figure 1:
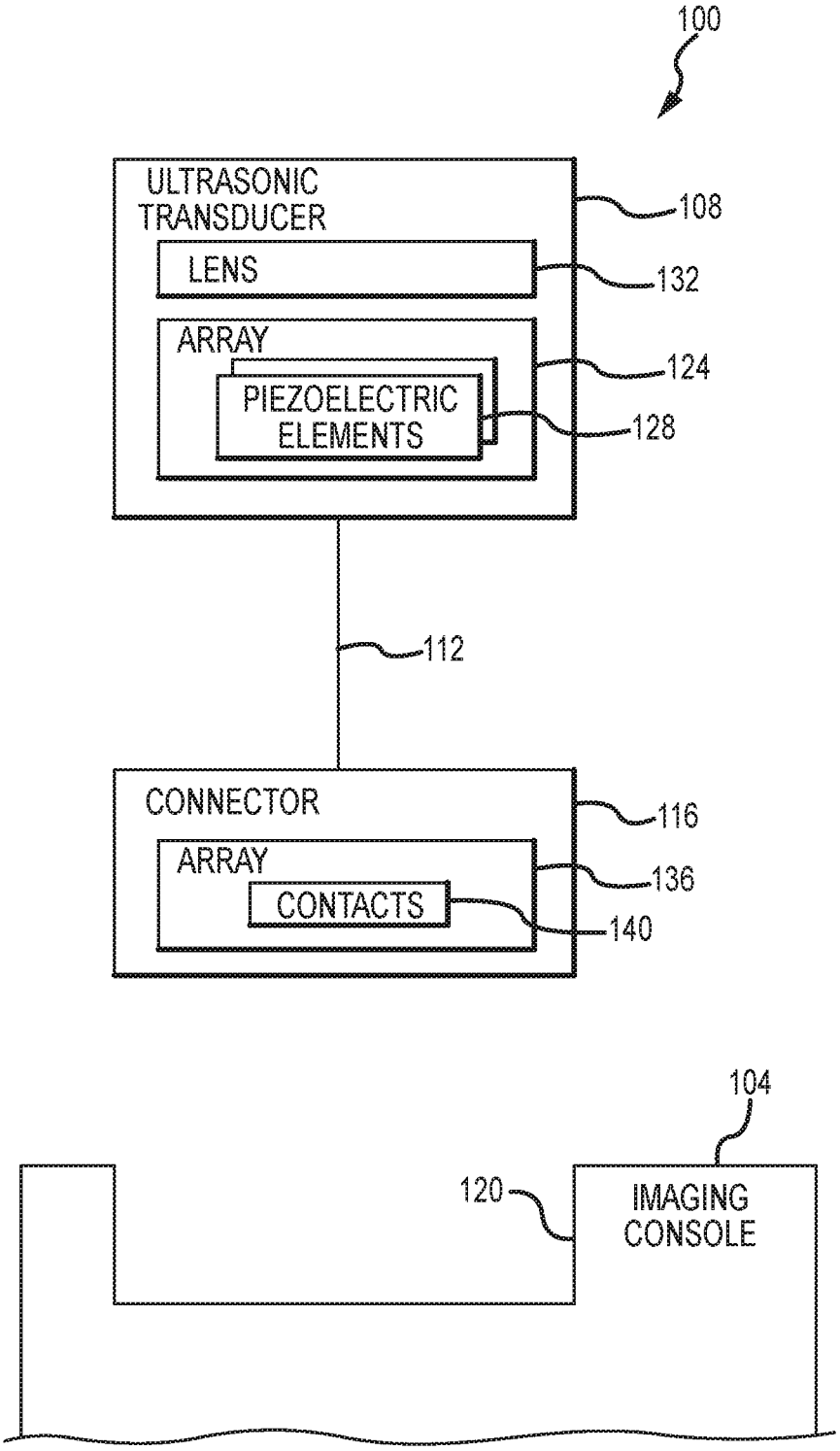
FIG. 1 is a block diagram of an ultrasonic imaging system according to one embodiment.

With initial reference to FIG. 1, a block diagram of one type of ultrasonic imaging system 100 to which the disclosed adapter 300 (illustrated in FIGS. 3-17) may be electrically connected is presented. Broadly, the system 100 may include an imaging console 104 and an ultrasonic transducer 108 (e.g., transducer head) that is electrically interconnectable to the imaging console 104 by any appropriate cable assembly 112 and a connector or connector assembly 116, where the connector assembly 116 is configured to interface with a corresponding port 120 on the imaging console 104. The imaging console 104 may transmit a drive signal to the ultrasonic transducer 108 to cause piezoelectric elements of the ultrasonic transducer 108 to transmit acoustic waves (e.g., ultrasound, ultrasonic waves) to a subject. The ultrasonic transducer 108 may be configured to receive reflection waves reflected by the interior of the subject and pass the same to the imaging console 104 for generation of one or more corresponding images. The ultrasonic transducer 108, cable assembly 112 and connector 116 may be referred to as an "acoustic probe," or "ultrasonic probe" or "ultrasound transducer."

The ultrasonic transducer 108 may include any appropriate array 124 of piezoelectric elements 128 (e.g., linear, curved linear, etc.) that transmit ultrasonic waves towards a subject area, where summing the contributions of the multiple piezoelectric elements 128 allows images to be formed. The ultrasonic transducer 108 may also include any appropriate lens 132 (e.g., layer of rubber) that covers the array 124 to provide electrical safety, acoustic focusing, impedance matching, disinfection, and/or the like. While not shown, the ultrasonic transducer 108 may also include one or more other components such as backing layers, electrical contacts, and the like.

Figure 2:
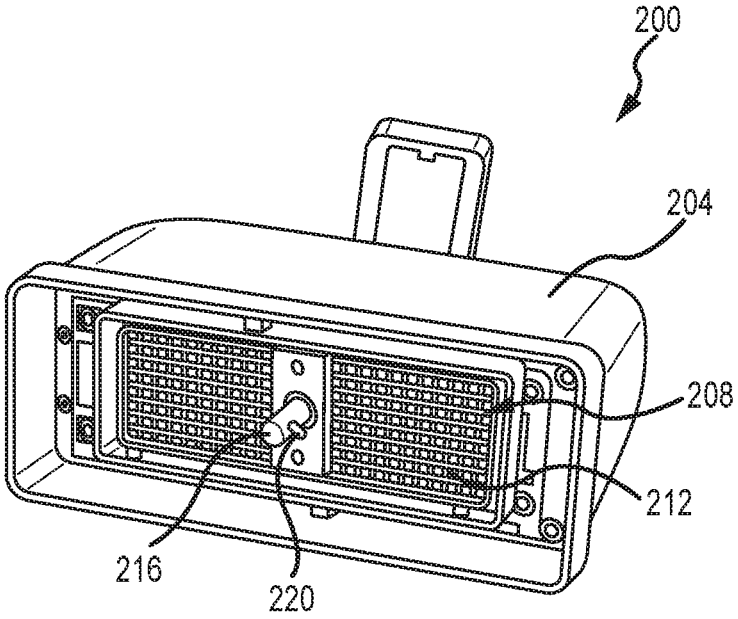
FIG. 2 is a perspective view of a multi-contact connector for electrically interconnecting an ultrasound transducer to an imaging console.

The connector assembly 116 may include any appropriate housing (e.g., shield, casing, etc.) as well as an array 136 of electrical contacts 140 (e.g., pins, pads, flat surfaces, etc.) that are configured to electrically connect the multiple piezoelectric elements 128 to the imaging console 104. More specifically, each respective contact 140 in the array 136 is directly electrically connected to a different respective piezoelectric element 128 of the ultrasonic transducer 108 via the cable assembly 112. For instance, FIG. 2 illustrates one example of a connector assembly 200 including a housing 204 and an array 208 (e.g., array 136) of electrical contacts 212 (e.g., electrical contacts 140).

Returning to FIG. 1, the imaging console 104 may be in the form of a housing including any appropriate arrangement of circuitry, components, and the like to receive inputs, generate corresponding drive signals to be transmitted to the piezoelectric elements 128 of the ultrasonic transducer 108 over cable assembly 112 and via the respective contacts 140 of the connector assembly 116 electrically interfaced with the imaging console 104. For instance, the imaging console 104 may include a control section including any appropriate arrangement of processing units (e.g., processors, CPUs, etc.), memory (e.g., volatile memory such as random access memory or the like), storage (e.g., non-volatile such as hard disk, flash, etc.), etc. for purposes of central controlling of the operation of each section the ultrasonic imaging system 100 in conjunction with one or more developed programs or code portions. The imaging console 104 may also include any appropriate operational input section (e.g., including switches, buttons, keyboard, etc.) in communication with the control section, a transmission section (e.g., circuitry) configured to transmit drive signals to the ultrasonic transducer 108 based on signals received from the control section, a receiving section (e.g., circuitry) configured to receive reflection ultrasound reception signals under control of the control section, and one or more displays configured to display ultrasonic images of the subject under control of the control section. Various additional details of the imaging console 104 have been omitted from this discussion in the interest of brevity.

As discussed previously, it is often necessary to electrically connect the array 136 of electrical contacts 140 of the ultrasound connector assembly 116 to an electrical device such as a testing unit for purposes of obtaining one or more electrical measurements, such as, as one example, electrical leakage values. Existing approaches to conducting electrical leakage testing of ultrasound system connectors that differ in various manners as discussed above include providing matched connector plugs for each style of available connector. More specifically, a different respective plug is designed to establish an electrical connection between each different respective connector and a testing unit for purposes of conducting electrical leakage tests of the various different connectors. However, this arrangement creates financial and logistical problems for users of existing electric leakage testing units.

Figure 3:
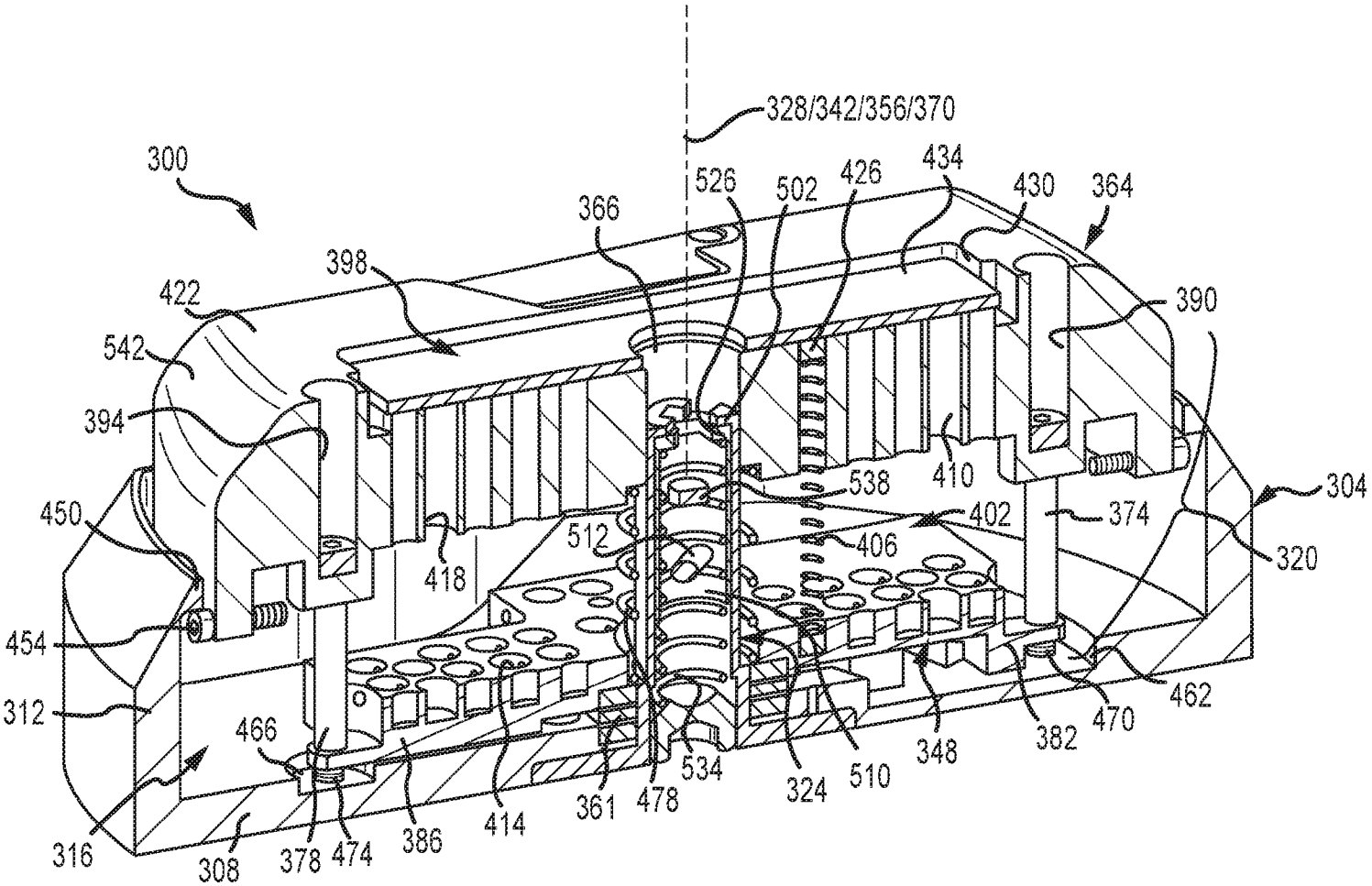
FIG. 3 is cutaway perspective view of a universal adapter according to one embodiment disclosed herein for making an electrical connection between an electrical device (e.g., testing device, such as for measuring electrical leakage) and various styles and configurations of ultrasound system connectors.
Figure 4:
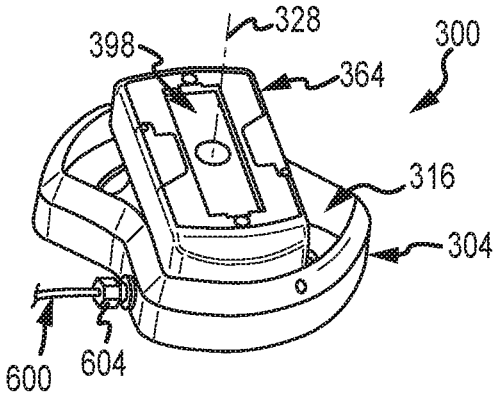
FIG. 4 is another perspective view of the adapter of FIG. 3.
Figure 5:
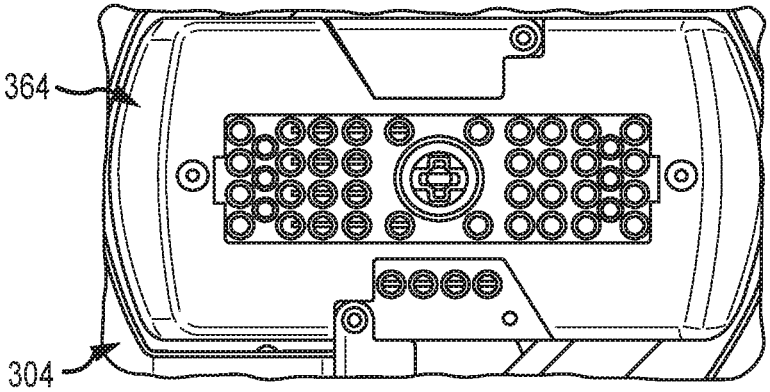
FIG. 5 is a top view of the adapter of FIG. 3 with some pieces removed for clarity.
Figure 6:
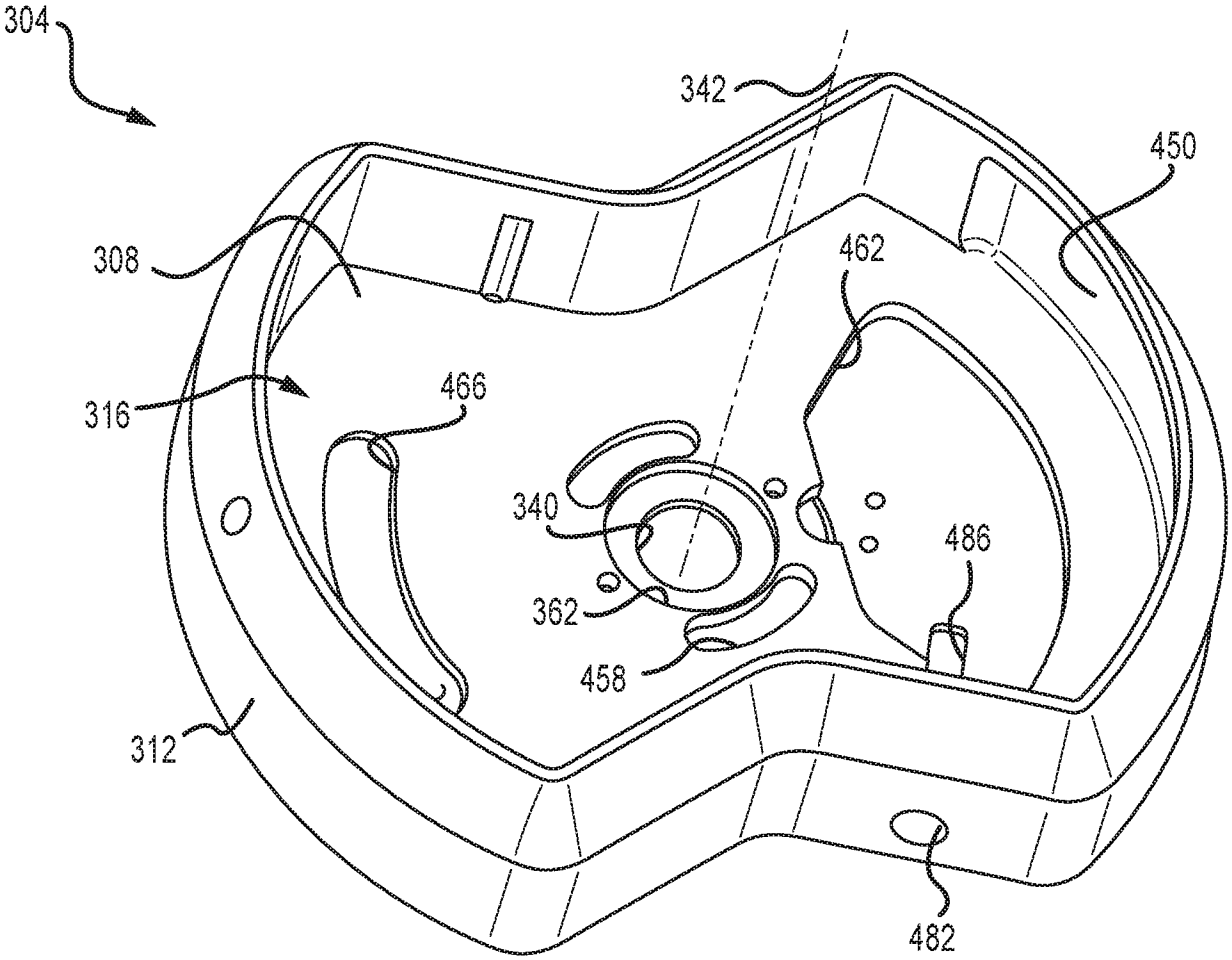
FIG. 6 is a top perspective view of a tray of the adapter of FIG. 3.
Figure 7:
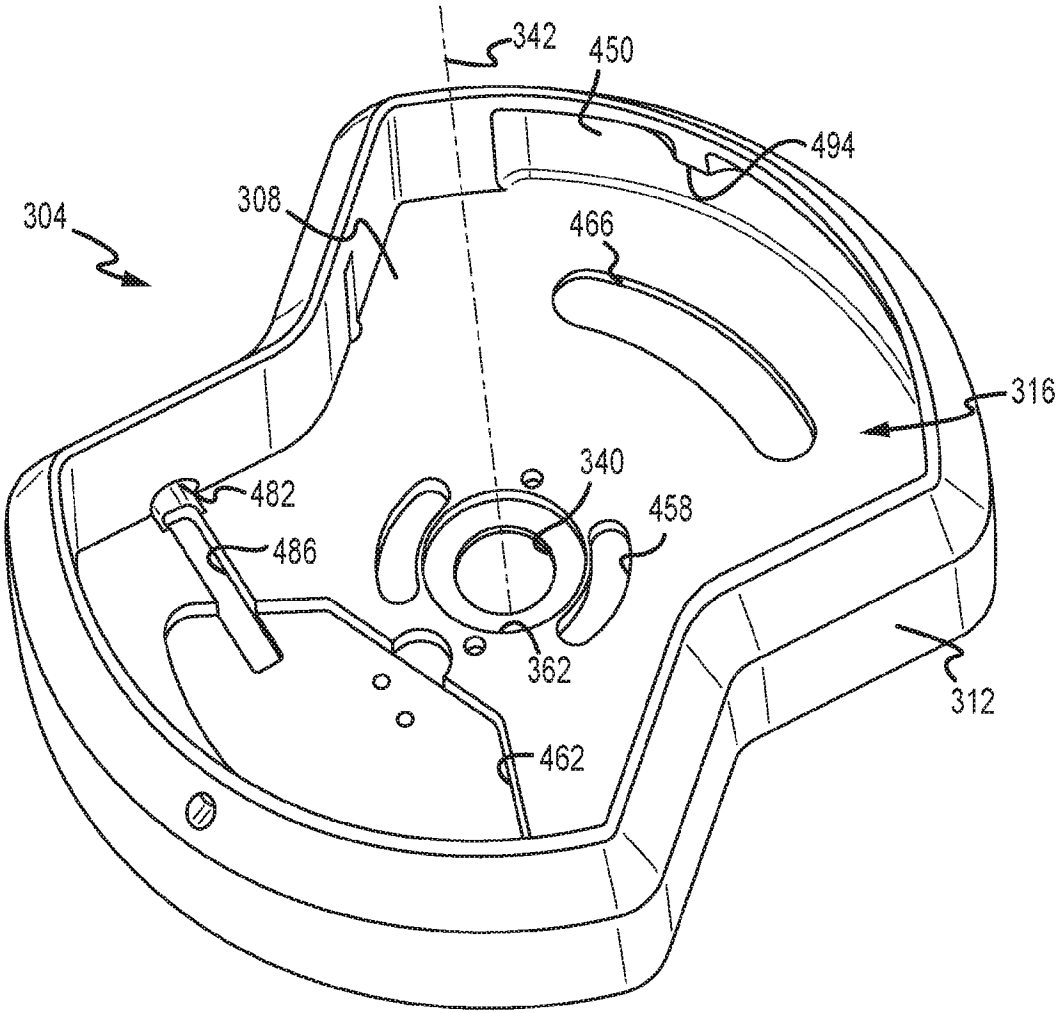
FIG. 7 is another top perspective view of the tray of FIG. 6, but from a different angle.
Figure 8:
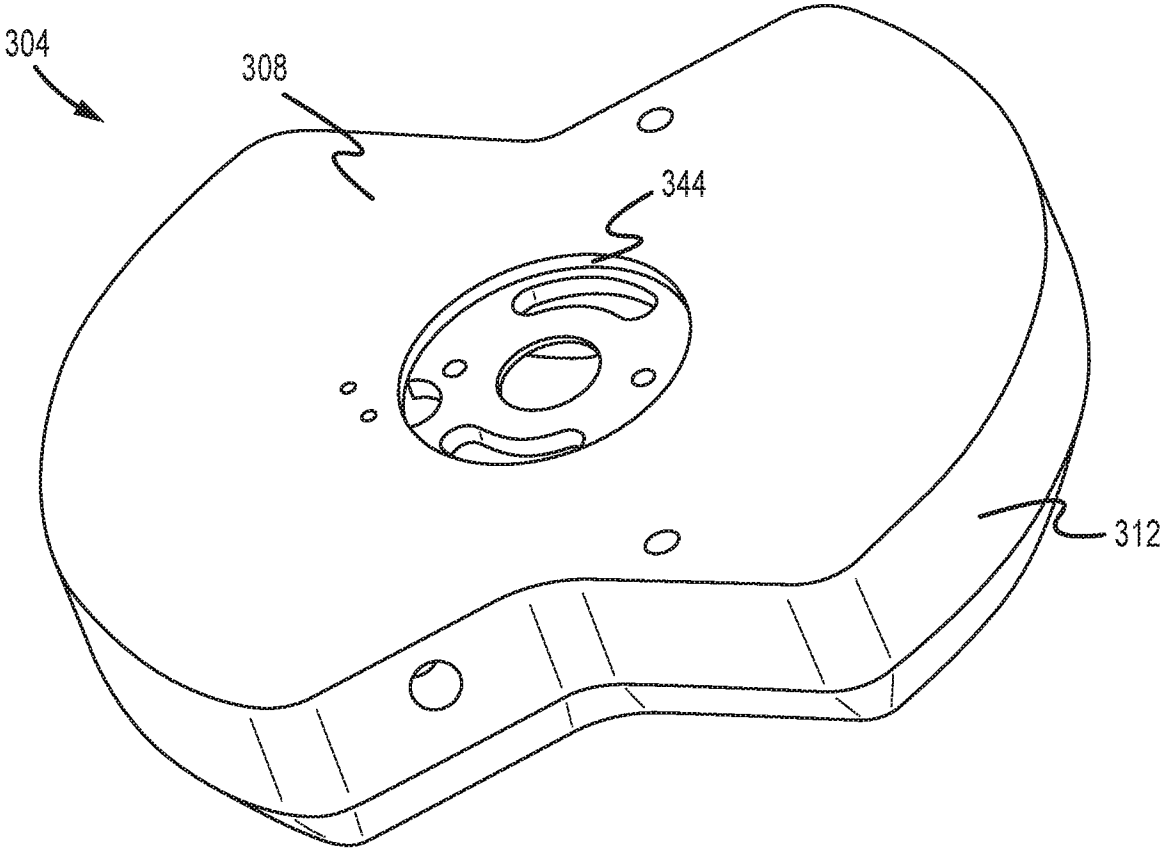
FIG. 8 is a bottom perspective view of the tray of FIG. 6.
Figure 16:
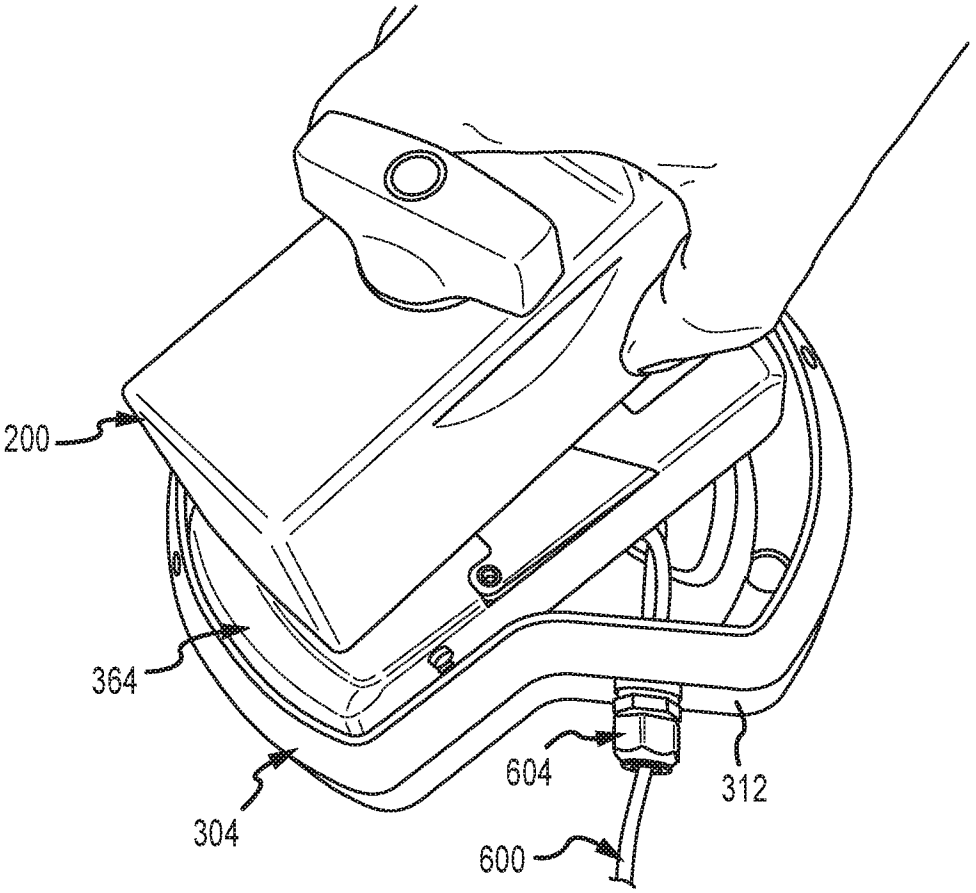
FIG. 16 is a perspective view of the ultrasound connector of FIG. 15 being disposed over the false floor of the adapter and the connector and false floor being in a first rotational position within a tray of the adapter in which there is no electrical connection between the connector and an electrical lead of an electrical apparatus.
Figure 17:
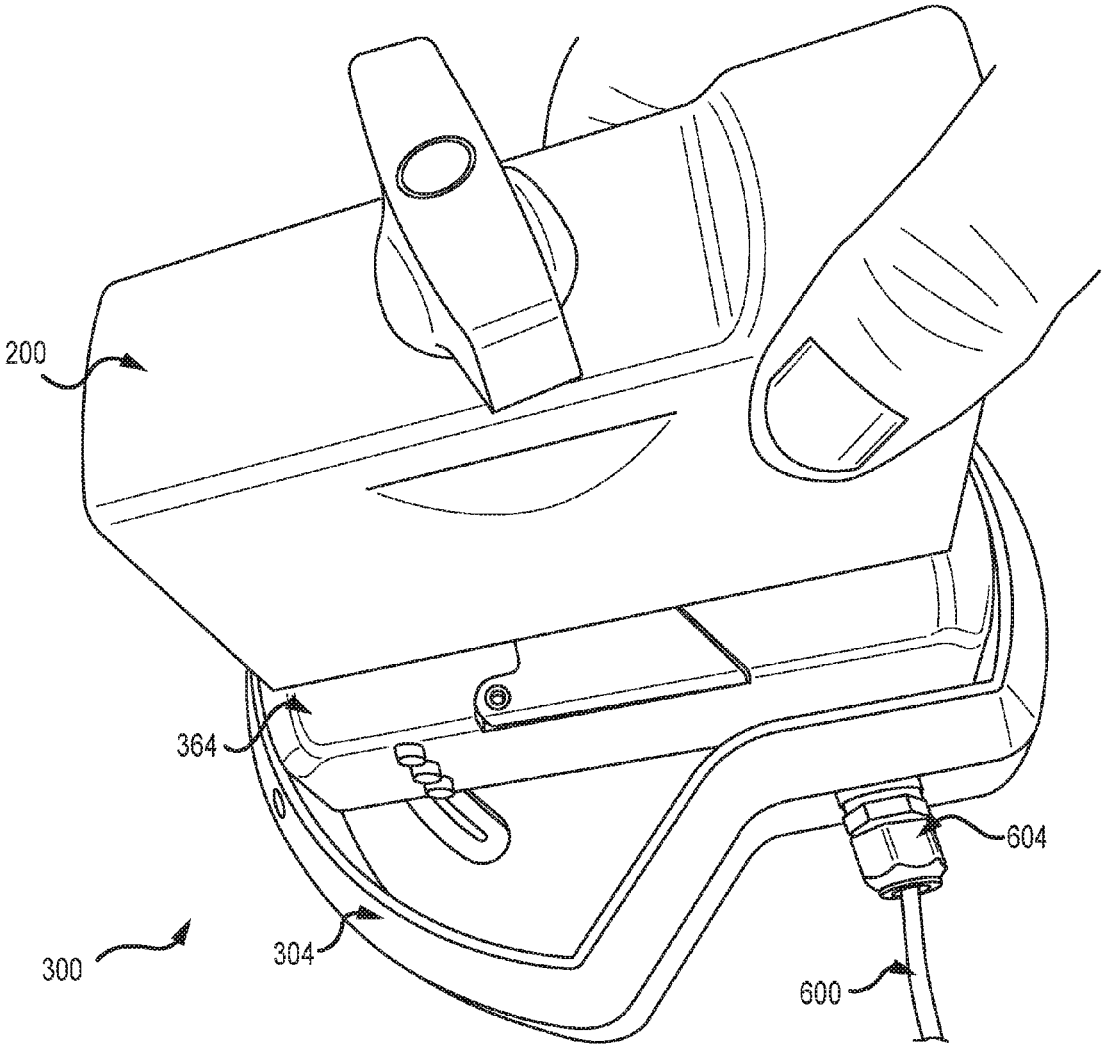
FIG. 17 is a perspective view similar to that in FIG. 16 but with the connector and false floor being in a second rotational position within the tray to establish an electrical connection between the connector and the electrical lead of the electrical apparatus.

Turning now to FIGS. 3-5, a universal adapter 300 (e.g., device, apparatus) for electrically connecting various types and configurations of ultrasound system connectors (e.g., connectors 116, 200) to an electrical apparatus is illustrated. Broadly, the adapter 300 includes a tray 304 (e.g., container, etc., also see FIGS. 6-8) including a housing constructed of any appropriate non-electrically conductive material (e.g., plastic, etc.) and generally including a base surface or floor 308 and a wall 312 (e.g., rim) extending away from and surrounding the floor 308 to define a receptacle 316 of the tray 304 within which an electrical connection unit or assembly 320 may be at least partially received for use in selectively establishing and disestablishing an electrical connection between an electrical apparatus and a connector of an ultrasound system. A shaft 324 may be attached or otherwise connected to or adjacent the floor 308 of the tray 304 so as to extend upwardly away from the floor 308. Also see FIG. 9. The shaft 324 may include a longitudinal axis 328 extending along and through a length thereof about which the electrical connection assembly 320 is configured to rotate between at least a first rotational position (e.g., as shown in FIG. 16) and a second rotational position (e.g., as shown in FIGS. 3, 4 and 17).

Figure 9:
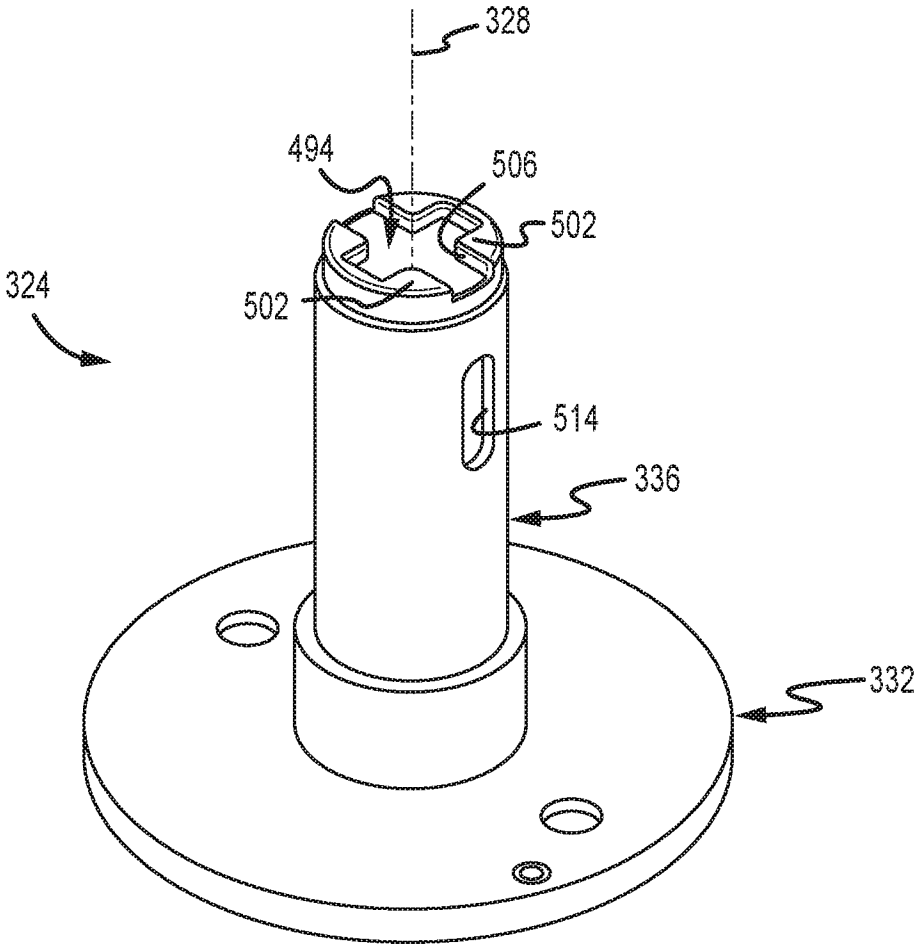
FIG. 9 is a perspective view of a shaft of the adapter of FIG. 3.

In one arrangement, the shaft 324 may be integrally attached to the floor 308 of the tray 304 so as to form a one-piece member with the tray 304. In another arrangement, the shaft 324 may be a separate piece (e.g., as shown in FIG. 9) that may be appropriately rigidly (e.g., non-movably) attached to the floor 308 of the tray 304. As an example, the shaft 324 may include a base 332 and a stem 336 extending away from the base 332 along the longitudinal axis 328 of the shaft 324. For instance, the stem 336 may be inserted through an aperture 340 through the floor 308 of the tray 304 so that an axis 342 extending through the aperture 340 (and perpendicular to the floor 308) is collinear with the longitudinal axis 328 of the shaft 324 and then the base 332 non-movably (e.g., non-rotatably) secured to the floor 308 such as by inserting fasteners (not shown) through corresponding bores in the base and floor (not labeled). In one arrangement, a lower or outside surface of the floor 308 may include a recess 344 (e.g., countersink) surrounding the aperture 344 and configured to receive the base 332. See FIGS. 3 and 8.

The electrical connection assembly 320 may be received over the shaft 324 (e.g., over the stem 336) for rotation about the longitudinal axis 328 within the receptacle 316 of the tray 304. Broadly, the electrical connection assembly 320 may include a base member 348 that is configured to be selectively brought into and out of direct electrical connection with an electrical lead 600 (e.g., pin, wire, etc.) of or electrically connectable to an electrical apparatus (e.g., testing device). Also see FIGS. 10-11. As shown, the base member 348 may be in the form of a bracket or block of material having an aperture 352 that is configured to receive the shaft 324 so that an axis 356 of the aperture 352 is collinear with the longitudinal axis 328 of the shaft 324. The base member 348 is rotatable about the axes 328, 356 and may be generally non-movable along the axes 328, 356. In one arrangement, a lower or outside surface of the base member 348 may include a recess 360 (e.g., countersink) surrounding the aperture 352 and configured to receive and/or contain any appropriate bearing assembly 361 to facilitate rotation of the base member 348 about the longitudinal axis 328 of the shaft 324. Additionally or alternatively, an upper surface of the floor 308 of the tray 304 may include a recess 362 (e.g., countersink) surrounding the aperture 340 configured to receive and/or contain the bearing assembly 361.

The electrical connection assembly 320 also includes a false floor 364 (e.g., platform) attached to the base member 348 for translation (e.g., linear movement) towards and away from the base member 348 along the longitudinal axis 328 of the shaft 324. Furthermore, the false floor 364 is non-rotatable relative to the base member 348 such that the false floor 364 and base member 348 are rotatable as a unit (e.g., simultaneously) about the longitudinal axis 328 of the shaft 324. Broadly, the false floor 364 is configured to directly receive the electrical contact array 136 of a various types and forms of ultrasound system connectors 116 and allow a user to selectively electrically interconnect the electrical contact array 136 of the connector 116 to an electrical lead 600 of an electrical apparatus. Also see FIGS. 12-13.

The false floor 364 may be in the form of a bracket and/or block of material (e.g., housing) having an aperture 366 that is configured to receive the shaft 324 so that an axis 370 of the aperture 366 is collinear with the longitudinal axis 328 of the shaft 324. The false floor 364 may be sized to be received within the receptacle 316 of the tray 304 and to receive the shaft 324 through the aperture 366 so that the false floor 364 is rotatable about the longitudinal axis 328 and translatable along the longitudinal axis 328 with confined ranges as discussed below. The false floor 364 may be slidably (e.g., translatably) connected to the base member 348 in any appropriate manner and biased away from the base member 348 against a portion of the wall 312 of the tray by a biasing force (e.g., a force according to Hooke's law) as discussed in more detail below.

As an example, one or more rods such as first and second rods 374, 378 may be rigidly or fixedly attached (e.g., via welds, threaded connection, etc.) to the base member 348 (e.g., such as at or adjacent first and second opposite ends 382, 386 of the base member 348) and configured to protrude away from the base member 348, where longintudinal axes (not shown) extending through the first and second rods 374, 378 are parallel to the longitudinal axis 328 of the shaft 324. The first and second rods 374, 378 (e.g., enlarged heads of the first and second rods 374, 378) may be slidably received in corresponding first and second slots 390, 394 of the false floor 364 that also have longitudinal axes extending therethrough that are parallel to the longitudinal axis 328 of the shaft 324. In this regard, sliding receipt of the heads of the first and second rods 374, 378 by the slots 390, 394 facilitates slidable translation of the false floor 364 towards and away from the base member 348. Furthermore, receipt of the first and second rods 374, 378 within the first and second slots 390, 394 inhibits relative rotation between the false floor 364 and the base member 348. Of course, the first and second (or additional) rods 374, 378 could be rigidly attached to the false floor 364 for slidable receipt in first and second slots 390, 394 of the base member 348. While one manner of slidably and non-rotatably connecting the false floor 364 and base member 348 to each other has been disclosed and shown, it is to be understood that other manners are envisioned and encompassed herein.

The false floor 364 has a docking portion 398 on an upper portion thereof that is generally configured to electrically receive the electrical contact array 136 of the connector 116 and facilitate the establishment of an electrical connection between the electrical contact array 136 and the electrical lead 600 of the electrical apparatus. An electrically conductive matrix 402 that defines a plurality of respective conductive paths 406 (only one shown in FIG. 3 in the interest of clarity) interconnects the docking portion 398 of the false floor 364 to the base member 348. The electrically conductive matrix 402 is broadly configured to electrically connect a plurality of respective receiving locations of the docking portion 398 to the base member 348, where the base member is configured to be selectively directly electrically connected to the electrical lead 600. Each of such receiving locations of the docking portion 398 may be configured to electrically receive (e.g., electrically contact) a corresponding electrical contact 140 of the array 136 of the connector 116 (although, as discussed previously, not necessarily every electrical contact 140 of the array 136).

As just one example, and as shown in FIG. 3, each of the conductive paths 406 of the conductive matrix 402 may be in the form of an electrically conductive biasing member (e.g., spring, coil spring) that is electrically connected between the docking portion 398 and the base member 348. For instance, the docking portion 398 of the false floor 364 and the base member 348 may each have a respective matrix of apertures (e.g., or slots) 410, 414 therein that are sized to receive respective ends of the conductive paths 406. Each aperture 410 of the docking portion 398 may be generally aligned with a corresponding one of the apertures 414 of the base member 348 such that an axis passing through a respective pair of apertures 410, 414 is generally parallel to the longitudinal axis 328 of the shaft 324.

The apertures 410 may extend from a bottom side 418 of the false floor 364 (where the bottom side faces the base member 348) to or towards an opposite top side 422 of the false floor 364 so that the ends of the conductive paths 406 may be inserted into the apertures 410 and extend to or adjacent the top side of the false floor 364 for direct or indirect electrical contact by one of the electrical contacts 140 of the array 136 of the connector 116. In one arrangement, the ends of the various conductive paths 406 of the conductive matrix 402 may be appropriately secured (e.g., via electrically conductive welds) within the apertures 410 adjacent the top side 422 of the false floor 364 so that upon an electrical contact array 136 of a connector 116 being received on or in the docking portion 398 of the false floor 364, at least some of the contacts 140 of the array 136 may be received in respective ones of the apertures 410 and make electrical contact with corresponding ones of the conductive paths 406 of the matrix 402. In another arrangement, the ends of each of the apertures 410 adjacent the top side 422 may be rigidly filled with an electrically conductive plug 426 of any appropriate material that is configured to contact the end of a particular conductive path 406 and limit the end of the conductive path 406 from passing through the end of the aperture 410. In this regard, electrical contact between a particular contact 140 of the connector 116 and a respective one of the plugs 426 thereby electrically connects the contact 140 to the respective conductive path 406.

In a further arrangement, the docking portion 398 of the false floor 364 may include a recessed portion 430 over the apertures 366, 410 that is configured (e.g., sized, shaped) to receive an electrically conductive layer 434 to facilitate electrical connection between the electrical contract array 136 of the connector 116 and the electrically conductive matrix 402. That is, the electrically conductive layer 434 may be appropriately received in the recessed portion 430 and fixed to the top side 422 of the false floor 364 over the apertures 410 so as to electrically contact the conductive paths 406 (e.g., the ends of the conductive paths 406) or any plugs 426 or the like that are electrically connected to the conductive paths 406. In this regard, the electrical contacts 140 of the array 136 of the connector 116 may contact substantially anywhere on the electrically conductive layer (e.g., not necessarily directly over the apertures 410) and establish electrical connections with the conducive paths 406. In one arrangement, the electrically conductive layer 434 may be in the form of conductive felt, such as a piece of any appropriate textile with metallic strands (e.g., stainless steel or the like) woven therethrough. The somewhat compressive nature of conductive felt advantageously facilitates robust electrical connections between the electrical contacts 140 of the array 136 of the connector 116 and the conductive paths 406 of the electrically conductive matrix 402.

Figure 10:
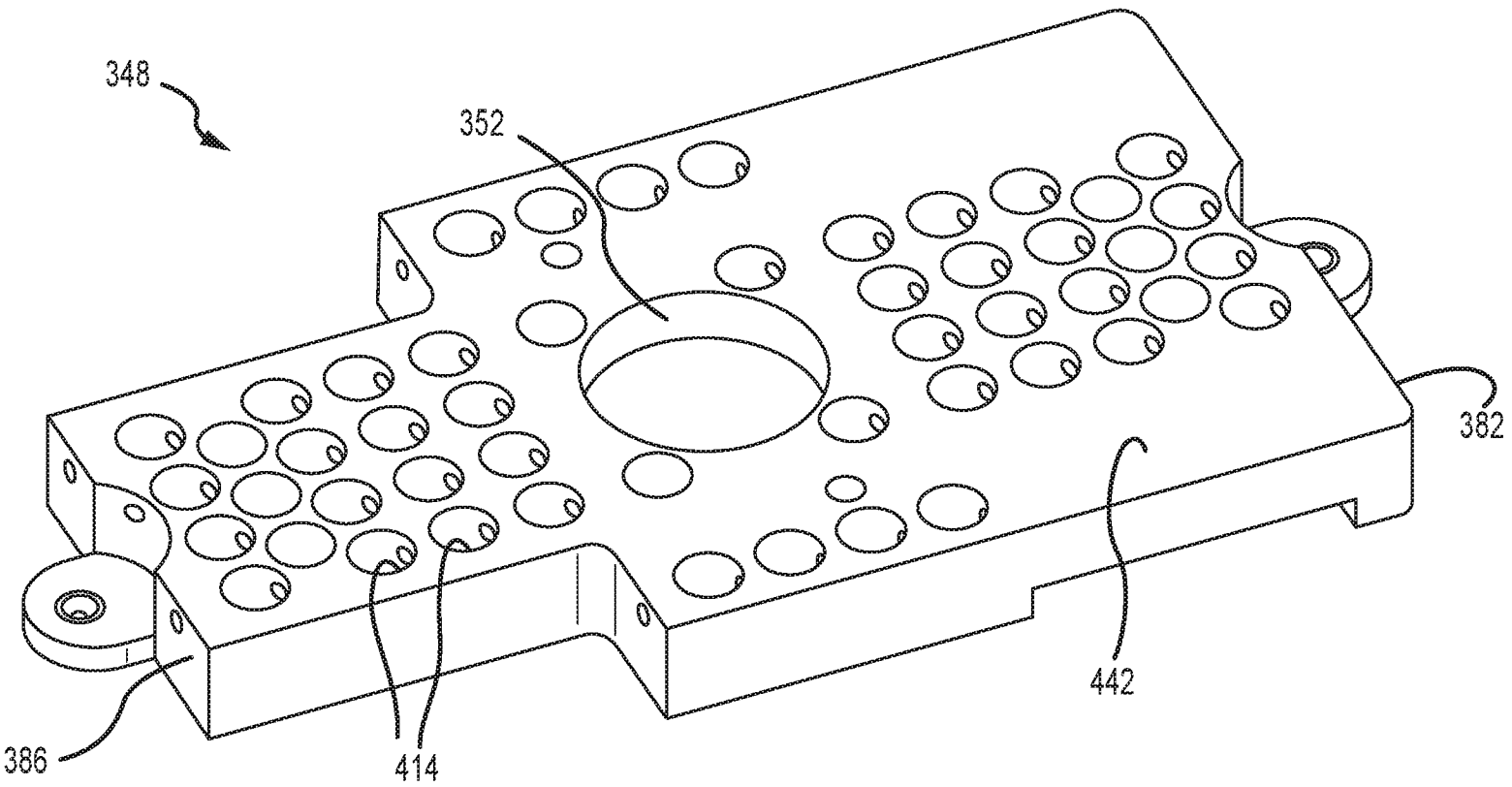
FIG. 10 is a top perspective view of a base member of the adapter of FIG. 3.
Figure 11:
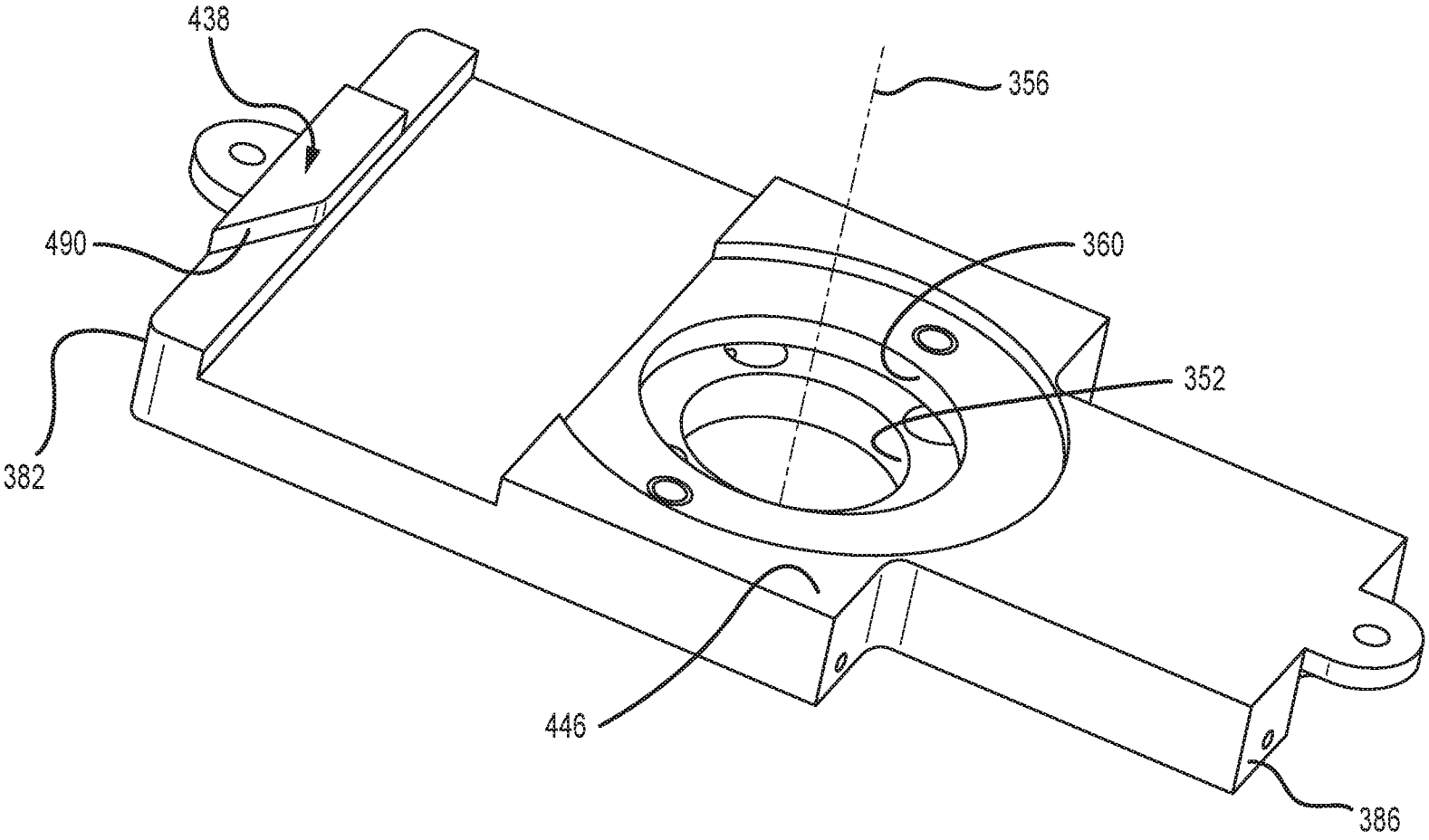
FIG. 11 is a bottom perspective view of the base member of FIG. 10.
Figure 12:
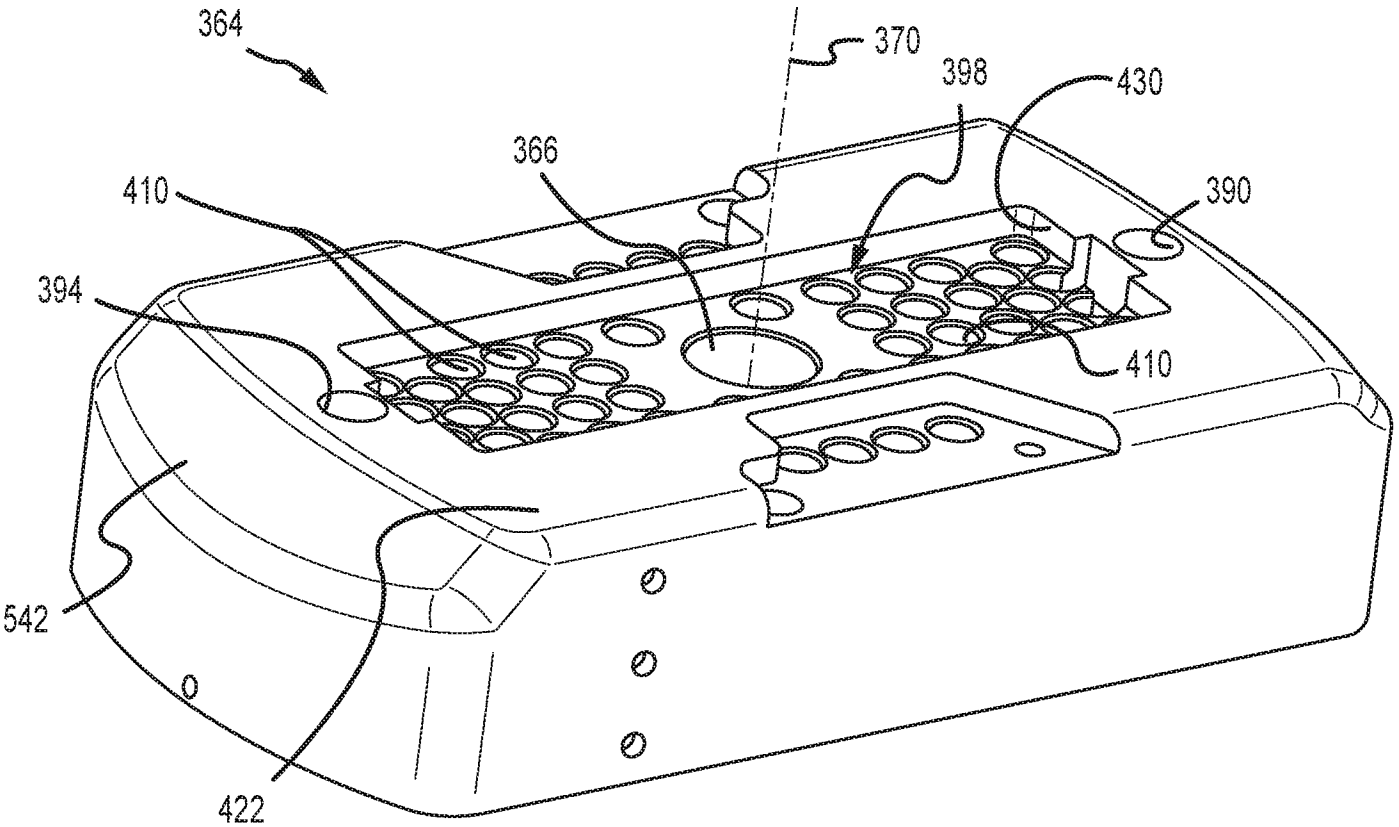
FIG. 12 is a top perspective view of a false floor of the adapter of FIG. 3.
Figure 13:
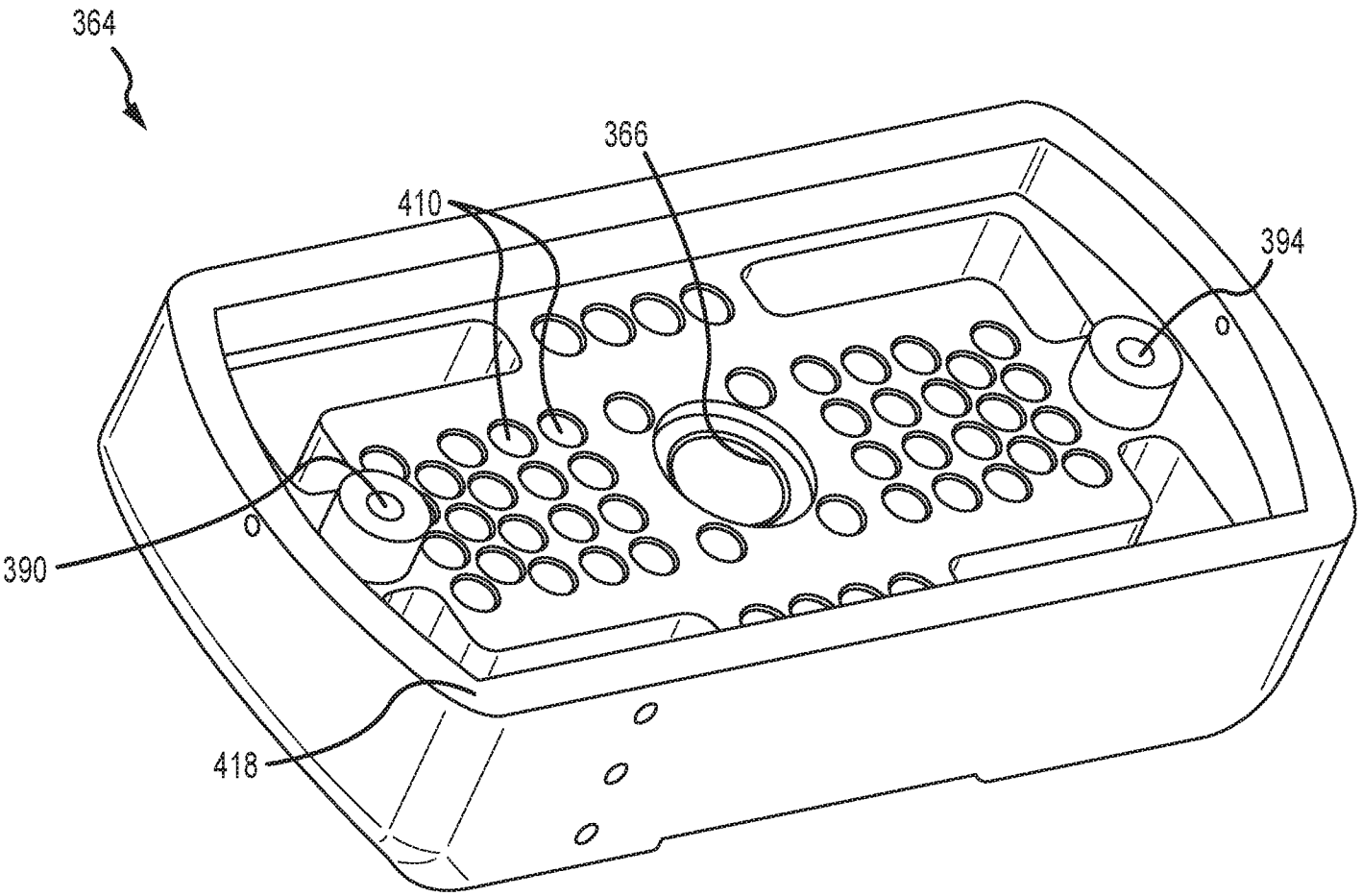
FIG. 13 is a bottom perspective view of the false floor of FIG. 12.
Figure 14:
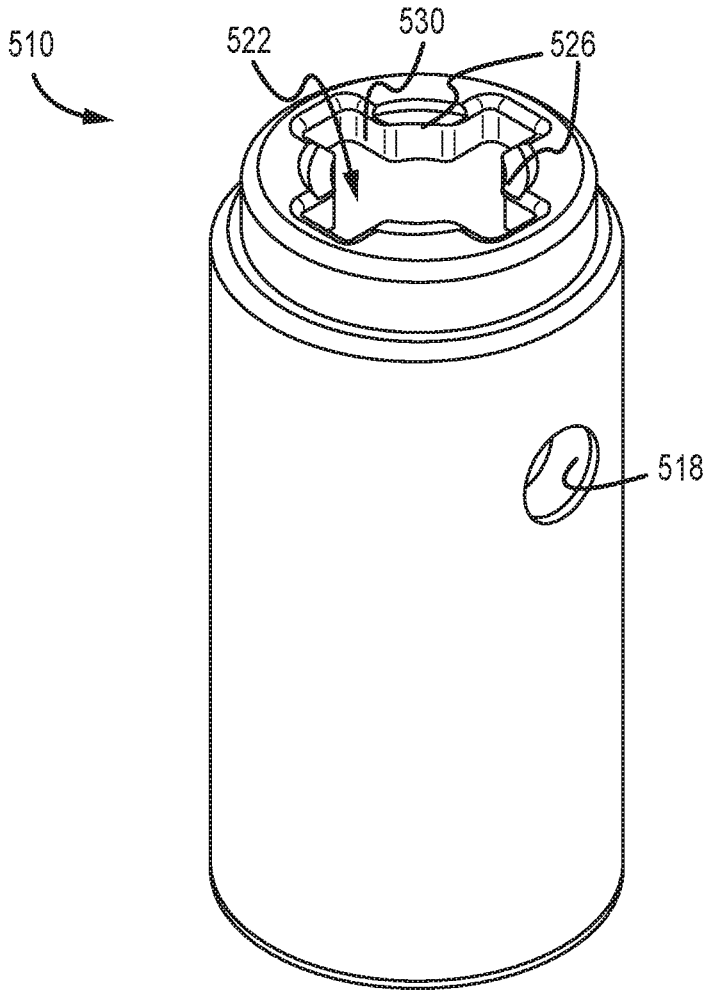
FIG. 14 is an isometric view of a plunger of the adapter of FIG. 3.

With reference to FIGS. 3, 10 and 11, the apertures 414 in the base member 348 are sized to receive opposite ends of respective ones of the conductive paths 406 of the conductive matrix 402, where all of the opposite ends of the conductive paths 406 are electrically connected to an electrically conductive component 438 (see FIG. 11) of the base member 348 that is adapted to be brought into and out of electrical contact with the electrically conductive lead 600 of the electrical apparatus. In one arrangement, and as shown, the apertures 414 in the base member 348 may extend from a top side 442 of the base member 348 toward but short of an opposite bottom side 446 of the base member 348 such that the apertures 414 have an open first end adjacent the top side 442 and an opposite closed second end. This arrangement allows the opposite ends of the conductive paths 406 to be seated within respective ones of the apertures 414 and contact the closed end walls of the apertures 414. In the case where the base member 348 is an integral block of electrically conductive material (e.g., metal, etc.), each of the conductive paths 406 may be electrically connected to the electrically conductive component 438 of the base member 348 through the body of the base member 348 itself. However, the base member 348 need not be in the form an integral block of electrically conductive material so long as each of the conductive paths 406 of the conductive matrix 402 is electrically connected to the electrically conductive component 438 of the base member 348 (e.g., such as by any appropriate network of conductive lines or paths disposed on or adjacent the bottom side 446 of the base member 348 that electrically interconnect the opposite second ends of the conductive paths 406 to the electrically conductive component 438 of the base member 348).

As mentioned previously, the false floor 364 is biased away from the base member 348 and the floor 308 of the tray 304 by a biasing force generated in any appropriate manner. The biasing force tends to push the false floor 364 into or towards an upper translational position along the longitudinal axis 328 of the shaft 324 (e.g., as shown in FIG. 3), where the false floor 364 is generally prevented or inhibited from translating or sliding to a position past the upper translational position. In one arrangement, an inside portion of the wall 312 of the tray 304 may include one or more ledges or rims 450 (e.g., "stop members(s)") protruding therefrom into the receptacle 316 that are configured to make contact with and resist movement of the false floor 364 in an upward direction parallel to the longitudinal axis away from the base member 348. For instance, the false floor 364 may include one or more corresponding stop members in the form of fasteners 454 rigidly attached to an outside surface of the body of the false floor 364 having heads that are configured to contact the rims 450 in the uppermost translational position of the false floor 364.

Additionally or alternatively, and in the case where the base member 348 is appropriately secured against movement along the longitudinal axis 328 in a direction away from the floor 308 of the tray 304, the false floor 364 may be restricted from linearly moving past the upper position shown in FIG. 3 upon the heads (not labeled) of the first and second rods 374, 378 making contact with portions of the false floor 364 defining the bottom of the first and second slots 390, 394. For instance, the floor 308 of the tray 304 may include one or more curved slots 458 defined therethrough about the aperture 340 that are configured to slidably receive fasteners or the like (not shown) extending from the bottom side 446 of the base member 348. For instance, such fasteners may include head portions disposed underneath the floor 308 of the tray 304 that are wider than the width of the slots 458 to inhibit movement of the base member away from the floor 308 but still allow for rotation of the base member (and thus the entire electrical connection assembly 320) about the longitudinal axis 328 of the shaft 324.

In one arrangement, each curved slot 458 may be of a predefined length that limits rotation of the base member 348 (and thus the entire electrical connection assembly 320) to a particular rotational range (e.g., 45 degrees, 90 degrees, etc.). In another arrangement, the floor 308 of the tray 304 may include one or more curved recesses such as first and second opposed curved recesses 462, 466 that are configured to slidably receive corresponding protrusions extending away from the bottom side 446 of the base member 348, such as first and second protrusions 470, 474. In one arrangement, the first and second protrusions 470, 474 may be ends of the first and second rods 374, 378. Additionally or alternatively, the first and second protrusions 470, 474 may be one or more other protrusions, tabs, etc. protruding away from the bottom side 446 of the base member 348 to ride in the first and second curved recesses 462, 466.

In a further arrangement, the footprint of the receptacle 316 of the tray 304 may be configured to limit rotation of the electrical connection assembly 320 to a particular rotational range. With reference to FIGS. 3, 6, 16 and 17, for instance, it can be seen how the wall 312 of the tray 304 may be specifically configured to limit rotational movement of the false floor 364 to a particular rotational range between the first and second rotational positions (e.g., respectively shown in FIGS. 16-17), such as by opposing portions of the wall 312 contacting outside portions of the false floor 364 to inhibit rotation of the false floor 364 past the first and second rotational positions.

The biasing force that tends to push the false floor 364 into or towards the uppermost translational position along the longitudinal axis 328 of the shaft 324 may, in one arrangement, be generated by the conductive paths 406 of the conductive matrix 402 when the conductive paths 406 are in the form of conductive biasing members such as coil springs. In this regard, the first ends of the conductive paths 406 may push against the docking portion 398, the plugs 426, the electrically conductive layer 434, etc. to push the false floor into or towards the uppermost translational position. Additionally or alternatively, a biasing member 478 (e.g., coil spring) may be appropriately disposed about the stem 336 of the shaft 324 between the top side 442 of the base member 348 and the bottom side 418 of the false floor 364 that is configured to urge the false floor 364 away from the base member 348. Other manners of generating a biasing force to bias the false floor 364 into or towards the uppermost position are also envisioned and encompassed herein.

As mentioned previously, the electrically conductive component 438 of the base member 348 is configured to be selectively brought into and out of electrical contact with an electrically conductive lead 600 of an electrical apparatus. In one arrangement, the electrically conductive component 438 may be in the form of a protrusion or the like extending away from the bottom side 446 of the base member 348 that is configured to ride or travel in the first recessed portion 462. For instance, in the case where the base member 348 is an integral block of electrically conductive material, the electrically conductive component 438 may simply be a portion of the block that protrudes into the first recessed portion 462.

In any case, the electrically conductive component 438 may be configured to travel over and into contact with a portion of the electrical lead inserted into the first recessed portion 462 when the base member 348 (and thus the whole electrical connection assembly 320) has been rotated into the second rotational position of FIGS. 4 and 17. For instance, an electrically conductive plug 604 of the electrical lead 600 may be inserted through an aperture 482 in the tray 304 (e.g., in the wall 312) and into the first recessed portion 462 so as to intersect the range of travel of the electrically conductive component 438 in the second rotational position of the electrically conductive component 438 (and thus of the electrical connection assembly 320), but not the first rotational position. In one arrangement, the guide slot or recess 486 interconnecting the aperture 482 to the first recessed portion 462 may guide the end of the electrically conductive plug 604 of the electrical lead 600 to a position whereby it will be contacted by the electrically conductive component 438 in the second rotational position of the electrical connection assembly 320 (e.g., as in FIGS. 4 and 17) but not contacted by the electrically conductive component 438 in the first rotational position of the electrical connection assembly 320 (e.g., as in FIG. 16). In one variation, the electrically conductive component 438 may, as shown in FIG. 11, include a tapered surface 490 that is configured to facilitate gradual, increasing contact with the electrically conductive plug 604 of the electrical lead 600 as the electrical connection assembly 320 moves into the second rotational position.

Figure 15:
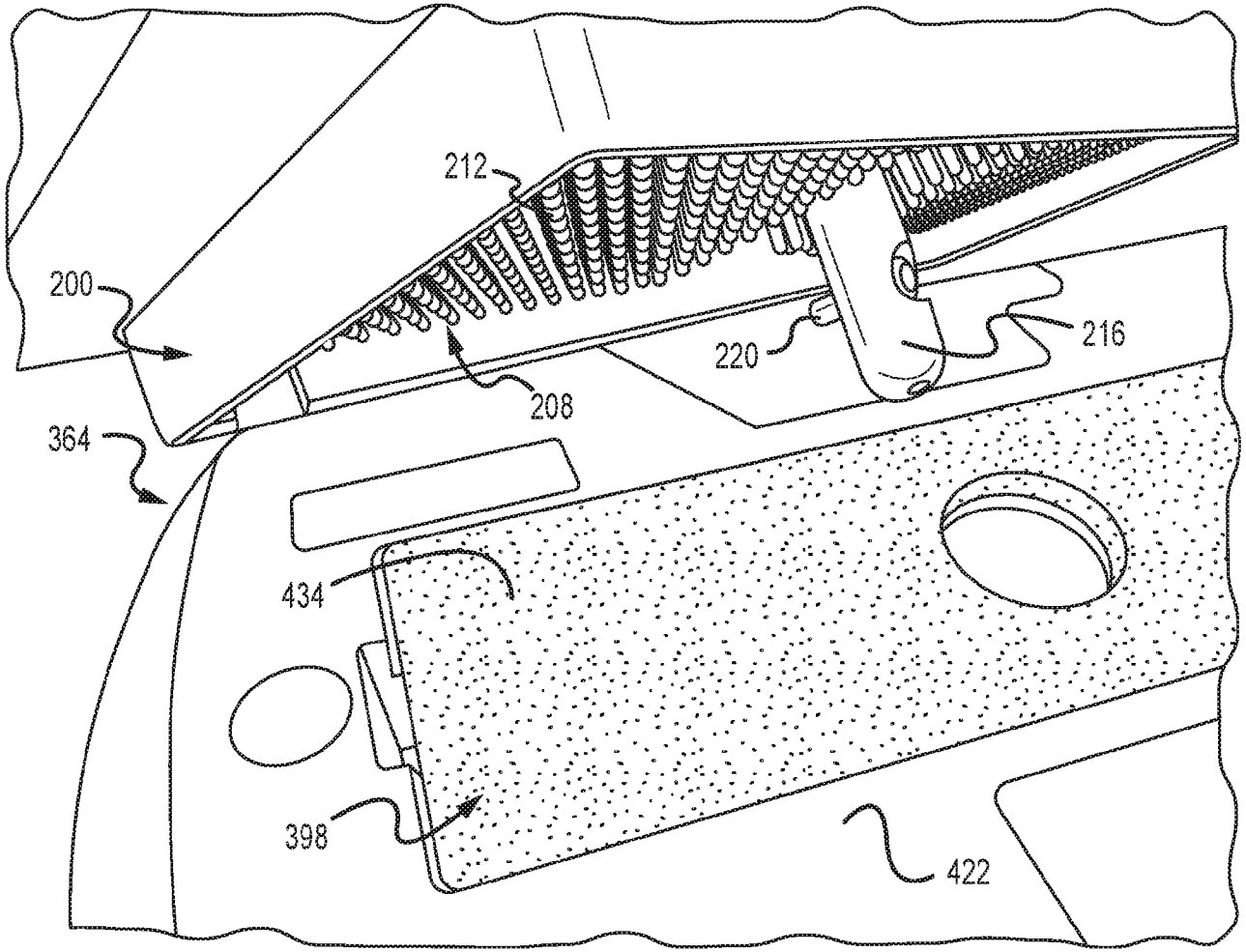
FIG. 15 is a perspective view of an electrical contact array of an ultrasound connector about to be electrically mated with the false floor of the adapter of FIG. 3

With the electrical connection assembly 320 in the first rotational position of FIG. 16 (e.g., so that the electrically conductive component 438 is not in contact with the electrically conductive plug 604 of the electrical lead 600), a user may grasp a connector 116 and press the electrical contact array 136 thereof into the docking portion 398 of the false floor 364 so that the contacts 140 of the array 136 electrically connect to at least some of the conductive paths 406 of the conductive matrix 402. For instance, FIG. 15 illustrates an electrical contact array 208 of a connector 200 in the process of being aligned over the electrically conductive layer 434 of the docking portion 398 of the false floor 364 while FIG. 16 illustrates the connector 200 after it has been fully received over and placed into contact with the docking portion 398 of the false floor 364. The connector 200 and electrical connection assembly 320 may then be simultaneously rotated about the longitudinal axis 328 of the shaft 324 (e.g., in one of a clockwise or counterclockwise direction) from the first rotational position into the second rotational position of FIG. 17 to contact the electrically conductive plug 604 of the electrical lead 600 (e.g., or other portion of the electrical lead within the first recessed portion 462) with the electrically conductive component 438 of the base member 348 and thereby establish an electrical connection between the electrical contact array 208 and the electrical apparatus (e.g., testing unit) via the electrical lead 600, the base member 348, the conductive matrix 402, and the docking portion 398 of the false floor 364. The electrical apparatus (e.g., testing unit) may then be activated and any appropriate electrical measurements (e.g., electrical leakage values) may then be obtained.

In one arrangement, a user may be required to depress or otherwise translate the connector 200 and false floor 364 along the longitudinal axis 328 of the shaft 324 towards the base member 348 against the biasing force (e.g., generated by the conductive matrix 402 and/or biasing member 478) before the electrical connection assembly 320 may be rotated into its second rotational position of FIG. 17 in which the electrically conductive component 438 of the base member 348 contacts the electrical lead 600. As an example, an inside portion of the wall 312 of the tray 304 may include a rotation prevention or stop member 494 (e.g., protrusion) extending therefrom within a path of rotational movement of a portion of the false floor 364 at the uppermost translational position of the false floor 364 along the longitudinal axis 328 (e.g., the translational position shown in FIG. 3).

For instance, the stop member 494 may inhibit rotational movement of the head of the fastener 454 of the false floor 364 (and thus inhibit rotational movement of the electrical connection assembly 320 as a whole) therepast absent the connector 200 and false floor 364 being depressed and rotated towards the second rotational position to allow the fastener head or other rotation prevention portion of the false floor 364 to clear the stop member 494. Once the fastener head or other rotation prevention portion of the false floor 364 has cleared the stop member 494, the biasing force may push the false floor 364 back into its uppermost translational position away from the base member 348 and the electrical connection assembly 320 may continue to be rotated into the second rotational position of FIGS. 3, 4 and 17. While one specific arrangement for inhibiting rotation of the electrical connection assembly 320 into its second rotational position absent depression of the connector 200 and false floor 364 has been discussed, it is to be understood that various other manners of doing so are envisioned and encompassed herein.

Some ultrasound system connectors such as ultrasound system connector 200 of FIGS. 2 and 15-17 include a locating shaft or stem 216 protruding from a front face (not labeled) of the connector 200 (e.g., adjacent the electrical contact array 208) that is configured to facilitate alignment and location of the connector 200 within the port 120 of an imaging console 104. The locating stem 216 may extend along a longitudinal axis (not shown) that is perpendicular to the electrical contact array 208. For instance, the locating stem 216 may be inserted into a corresponding aperture in the port 120 of the imaging console to align the electrical contact array 208 with corresponding electrical contacts of the port 104. The locating stem 216 may further include at least one (e.g., one or more) locking pin 220 extending perpendicularly therefrom that is configured to engage with a corresponding catch, opening, and/or the like within the opening in which the locating stem 216 is inserted to inhibit removal of the locating stem 216 from the aperture and thus the connector 200 from the port 120 (e.g., until the locking pin 220 is released from the catch, opening, etc. in any appropriate manner).

In any case, the device 300 may be configured to slidably receive a locating stem 216 of the connector 200 to generally align the electrical contact array 208 with the docking portion 398 (e.g., with the electrically conductive layer 434) and catch the locking pin 220 in the second rotational position of the electrical connection assembly 200 to inhibit removal of the connector 200 from the false floor 364 and ensure a robust electrical connection between the electrical contact array 208 and the electrically conductive layer 434 absent the connector 200 and false floor 364 being again depressed and rotated in the other of the clockwise or counterclockwise directions back into the first rotational position of the electrical connection assembly 320. For instance, and as shown in FIGS. 3 and 9, the shaft 324 may be in the form of a tubular member having a passageway 498 extending therethrough along the longitudinal axis 328 thereof that is configured to slidably receive the locating stem 216 of the connector 200 to facilitate location of the connector 200 over the docking portion 398 of the false floor 364.

The shaft 324 may include a plurality of locking tabs 502 rigidly protruding into the passageway 498 (e.g., adjacent an end of the shaft 324 and/or at other appropriate locations) and defining slots or openings 506 therebetween for slidable receipt of the one or more locking pins 220 of the locating stem 216. For instance, a user may initially align the locating stem 216 with the aperture 366 of the false floor 364 and passageway 494, and the at least one locking pin 220 with one of the slots 506 (e.g., while confirming that the electrical contact array 208 is generally aligned with the docking portion 398 of the false floor 364) and then insert the locating stem 216 and locking pin 220 into the passageway 494 and slot 506, respectively, at least until the locking pin 220 has passed or cleared the adjacent locking tabs 502 defining the slot 506 through which the locking pin 220 was inserted.

Before the locking pin 220 has cleared the adjacent locking tabs 502, however, the electrical contact array 208 of the connector may contact the docking portion 398 of the false floor (e.g., the electrically conductive layer 434) and begin depressing or translating the false floor 364 at least slightly towards the base member 348 against the biasing force of the conductive matrix 402, the biasing member 478, and/or the like. Once the locking pin 220 has cleared the locking tabs 502, rotation of the connector 200 and false floor 364 about the longitudinal axis 328 of the shaft 324 into the second rotational position brings the locking pin 220 under one of the locking tabs 502. As discussed previously, depression of the connector 200 and false floor 364 may also include clearing the head of the fastener 454 or other rotation prevention member of the false floor 364 past the stop member 494 of the tray 304 to allow the electrical connection assembly 320 to be pivoted or rotated into the second rotational position.

Once the electrical connection assembly 320 has reached the second rotational position and the user has let go of the connector 200 and false floor 364, the previously mentioned biasing force presses the electrically conductive layer 434 (e.g., or other portion of the docking portion 398) against the electrical contact array 208 of the connector 200 (e.g., to ensure a solid and robust electrical connection between the electrical contact array 208 and the electrically conductive layer 434) which simultaneously forces the locking pin 220 against the underside of the one of the locking tabs 502. Depending upon the configuration (e.g., shape, size) of locating stem 216 and locking pin(s) 220, the false floor 364 may not necessarily return to its uppermost translational position along the longitudinal axis 328 in the second rotational position of the electrical connection assembly 320. In any case, the connector 200 thus generally is inhibited from being removed from the device 200 (e.g., pulled out of the docking portion 398 of the false floor 364) unless the connector 200 and false floor 364 are depressed towards the base member 348 and rotated in the other of the clockwise or counterclockwise directions about the longitudinal axis 328 back into the first rotational position so that the locking pin 220 comes out from under the locking tab 502 and again aligns with one of the slots 506.

In some arrangements (e.g., for certain shape and configurations of locating stems 216 and locking pins 220), the biasing force of the conductive matrix 402, biasing member 478 and/or the like may not be sufficient to force the locking pin 220 against the underside of one of the locking tabs 502 in the second rotational position of the electrical connection assembly 320. In this regard, a tubular plunger 510 (see FIGS. 3 and 14) may be slidably received in the passageway 494 of the shaft 324 and held against rotation relative to the shaft 324 in any appropriate manner (e.g., such as by a fastener or pin 512 being inserted through a slot 514 in a sidewall of the stem 336 of the shaft 324 and an aperture 518 in a sidewall of the plunger 510). The plunger 510 includes a passageway 522 extending therethrough along a longitudinal axis (not shown) that is collinear with the longintudinal axis 328 of the shaft 324. Furthermore, the plunger 510 includes a plurality of locking tabs 526 rigidly protruding into the passageway 522 (e.g., adjacent an end of the plunger) and defining slots or openings 530 therebetween for slidable receipt of the one or more locking pins 220 of the locating stem 216. The locking tabs 526 of the plunger 510 are configured to be aligned with and biased against the locking tabs 502 of the shaft 324 by any appropriate biasing member(s). For instance, a spring 534 (e.g., coil spring) may be received within the passageway 522 of the plunger 510 and configured to press against the pin 512 to urge the plunger 510 upwardly along the longitudinal axis 328 so that the locking tabs 526 press against the bottoms of the respective locking tabs 502 of the shaft (e.g., as shown in FIG. 3). The plunger 510 may linearly move along the longitudinal axis 328 independently of the false floor 364.

Upon insertion of certain types of locating stems 216 through the aperture 366 of the false floor 364 and into the passageways 494, 522 so that the locking pin 220 slides through the aligned slots 506, 530 of the shaft 324 and plunger 510, the locating stem 216 (e.g., a free end of the locating stem 216 or the locking pin 220) may contact a protrusion 538 of the plunger 510 extending into the passageway 522 and spaced from the locking tabs 526 and force the plunger 510 to translate or slide downwardly along the longitudinal axis 328 towards the base member 348 and floor 308 against the biasing force of the spring 534; this motion of the plunger pulls the locking tabs 526 of the plunger 510 away from the locking tabs 502 of the shaft 324 (although the locking tabs 526, 502 are still aligned as the plunger 510 and shaft 324 are non-rotatable relative to each other). Once the electrical connection assembly 320 has been rotated into the second rotational position of FIGS. 3, 4 and 17 and released, the biasing force of the conductive matrix 402/biasing member 478 pushing upward on the false floor 364 along with the biasing force of the spring 534 pushing upward on the locating stem 216 or locking pin 220 urges the locking pin 220 against the underside of one of the locking tabs 526 of the plunger 510 and the locking tabs 526 of the plunger 510 against the underside of the locking tabs 502 of the shaft 324 to lock the connector 200 onto the false floor 364 (e.g., inhibit linear movement or translation of the connector 200 away from the false floor 364 absent a user depressing connector 200 and false floor 364 and rotating back into the first rotational position) while maintaining robust electrical contact between the electrical contact array 208 of the connector 200 and the docking portion 398 of the false floor 364 (e.g., with the electrically conductive layer 434).

When the connector 200 and electrical connection assembly 320 are in the second rotational position of FIGS. 3, 4 and 17, a user may be substantially shielded or insulated from electrical leads or contacts by the tray 304, the false floor 364, and the body of the connector 200. As discussed previously, the tray 304 may be constructed of any appropriate non-conductive material. Furthermore, the false floor 364 may include a non-conductive housing 542 that is generally configured to surround the docking portion 398.

It will be readily appreciated that many additions and/or deviations may be made from the specific embodiments disclosed in the specification without departing from the spirit and scope of the invention. In one arrangement, the electrical contact array 208 of the connector 200 could be disposed over the docking portion 398 and the connector 200 and false floor 364 depressed and rotated into the second rotational position free of bringing the locking pin 222 under the locking tabs 502, 526 of the shaft 324 and plunger 510 during the rotation of the connector 200 and false floor 364 as discussed previously. Instead, after the connector 200 and false floor 364 were rotated into the second rotational position, a user could lock the connector 200 to the device 300 by way of rotating a locking knob of the connector 200 that is connected to the locating stem and/or locking pin 222 to again achieve appropriate conduction for testing or the like. This arrangement may be advantageous in the case of non-normal style connectors 200.

Furthermore, the illustrations and discussion herein has only been provided to assist the reader in understanding the various aspects of the present disclosure and that one or more various combinations of the above discussed arrangements and embodiments are also envisioned. Additionally, the various uses of "first," "second," etc. herein have only been provided to assist the reader in understanding the various functionalities presented herein and do not necessarily limit the scope thereof.

While this specification contains many specifics, these should not be construed as limitations on the scope of the disclosure or of what may be claimed, but rather as descriptions of features specific to particular embodiments of the disclosure. Furthermore, certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The above described embodiments including the preferred embodiment and the best mode of the invention known to the inventor at the time of filing are given by illustrative examples only.

What is claimed is:

1. A device for selectively establishing an electrical connection between a connector of an ultrasound system and an electrical apparatus, comprising:

a tray including a floor and a wall extending away from and surrounding the floor to define a receptacle of the tray;

a shaft non-movably fixed to the floor within the receptacle, wherein the shaft includes a longitudinal axis that extends away from the floor; and an electrical connection assembly rotatably secured about the shaft within the receptacle to selectively establish an electrical connection between a connector of an ultrasound system and an electrical apparatus, wherein the electrical connection assembly includes:

a base member fixed over the floor for rotation about the longitudinal axis of the shaft;

a false floor attached to the base member for translation towards and away from the base member along the longitudinal axis of the shaft, wherein the false floor is non-rotatable relative to the base member; and a conductive matrix that defines a plurality of conductive paths between a docking portion of the false floor that is configured to receive an array of electrical contacts of the connector and the base member, wherein translation of the false floor along the longitudinal axis of the shaft and rotation of the electrical connection assembly in one of a clockwise or counterclockwise direction from a first into a second rotational position of the electrical connection assembly is configured to establish an electrical connection between the base member and a conductive lead of the electrical apparatus to electrically connect the electrical apparatus to the conductive matrix, and wherein translation of the false floor along the longitudinal axis of the shaft and rotation of the electrical connection assembly in the other of the clockwise or counterclockwise direction from the second rotational position into the first rotational position of the electrical connection assembly is configured to disestablishes the electrical connection between the base member and the conductive lead of the electrical apparatus to electrically disconnect the electrically apparatus from the conductive matrix.

2. The device of claim 1, wherein the docking portion includes a conductive layer in electrical contact with the plurality of conductive paths of the conductive matrix.

3. The device of claim 2, wherein the conductive layer is conductive felt.

4. The device of claim 2, wherein the docking portion includes a depression in an upper portion of a housing of the false floor, and wherein the conductive layer is seated within the depression.

5. The device of claim 1, wherein the false floor is biased away from the base member against a portion of the tray in the first and second rotational positions of the electrical connection assembly by a biasing force.

6. The device of claim 5, wherein one of the false floor or tray includes a first rotation prevention member, wherein the other of the false floor or tray includes a second rotation prevention member, and wherein the first and second rotation prevention members engage to prevent rotation of the electrical connection assembly about the longitudinal axis of the shaft between the first and second rotational positions of the electrical connection assembly absent the false floor being translated along the longitudinal axis of the shaft towards the base member against the biasing force.

7. The device of claim 5, wherein each of the plurality of conductive paths of the conductive matrix is formed by a respective conductive biasing member, wherein the plurality of conductive biasing members assist in generating the biasing force.

8. The device of claim 5, further including a spring disposed about the shaft between the base member and the false floor, wherein the spring assists in generating the biasing force.

9. The device of claim 1, wherein each of the plurality of conductive paths of the conductive matrix is formed by a respective conductive biasing member, wherein the plurality of conductive biasing members generate a biasing force that biases the false floor away from the base member against a portion of the tray in the first and second rotational positions of the electrical connection assembly.

10. The device of claim 1, further including at least a first pin rigidly attached to the base member and including a longitudinal axis that is parallel to the longitudinal axis of the shaft, wherein the first pin is slidably received in a first slot of the false floor to guide translation of the false floor along the shaft, and wherein the first pin inhibits relative rotation between the false floor and the base member.

11. The device of claim 10, further including a second pin rigidly attached to the base member and including a longitudinal axis that is parallel to the longitudinal axis of the shaft, wherein the second pin is slidably received in a second slot of the false floor to guide translation of the false floor along the shaft, wherein the second pin inhibits relative rotation between the false floor and the base member, and wherein the first and second pins are disposed on opposite first and second ends of the base member.

12. The device of claim 1, wherein the shaft is a tubular shaft having a passageway extending therethrough along the longitudinal axis of the shaft that is configured to receive a locating stem of the connector when the electrical contact array of the connector is received in the docking portion of the false floor.

13. The device of claim 12, wherein the tubular shaft includes a plurality of locking tabs protruding into the passageway and defining openings between adjacent ones of the locking tabs, wherein the openings are configured to receive one or more locking pins of the locating stem therethrough in a direction parallel to or along the longitudinal axis of the shaft, and wherein the locking tabs are configured to inhibit movement of the locating stem in a direction parallel to or along the longitudinal axis of the shaft.

14. The device of claim 13, further including a tubular plunger slidably received in the passageway of the locating stem, wherein the tubular plunger includes a plurality of locking tabs protruding into the passageway and defining openings between adjacent ones of the locking tabs, wherein the locking tabs and openings of the plunger are respectively aligned with the locking tabs and the openings of the shaft, and wherein the locking tabs of the plunger are biased against the locking tabs of the shaft by a biasing member.

15. The device of claim 1, wherein the false floor includes a housing that surrounds the docking portion, wherein the housing is non-conductive.

16. The device of claim 1, wherein the base member is conductive.

17. The device of claim 1, wherein the false floor includes a matrix of apertures extending therethrough that are respective configured to receive the matrix of conductive paths.

18. The device of claim 14, wherein the shaft and plunger are not rotatable relative to each other.

19. The device of claim 7, wherein each respective conductive biasing member is a coil spring.

20. The device of claim 3, wherein the conductive felt includes:

a textile and metallic material interwoven into the textile.

21. The device of claim 1, wherein the tray is non-conductive.

22. The device of claim 1, wherein the false floor has an aperture extending therethrough that receives the shaft.

* * * * *